US010738665B2

(12) United States Patent
Dietrich et al.

(10) Patent No.: US 10,738,665 B2
(45) Date of Patent: Aug. 11, 2020

(54) SLIDING CAM SYSTEM

(71) Applicant: MAN Truck & Bus AG, München (DE)

(72) Inventors: Jens Dietrich, Heilsbronn (DE); Thomas Malischewski, Heilsbronn (DE); Steffen Hirschmann, Neustadt an der Aisch (DE)

(73) Assignee: MAN TRUCK & BUS AG, Munich (DE)

( * ) Notice: Subject to any disclaimer, the term of this patent is extended or adjusted under 35 U.S.C. 154(b) by 0 days.

(21) Appl. No.: 16/116,427

(22) Filed: Aug. 29, 2018

(65) Prior Publication Data

US 2019/0072009 A1 Mar. 7, 2019

(30) Foreign Application Priority Data

Sep. 1, 2017 (DE) ..... 10 2017 120 145

(51) Int. Cl.
*F01L 1/344* (2006.01)
*F01L 13/00* (2006.01)
(Continued)

(52) U.S. Cl.
CPC ..... *F01L 1/3442* (2013.01); *F01L 1/0532* (2013.01); *F01L 13/0036* (2013.01);
(Continued)

(58) Field of Classification Search
CPC ... F01L 2001/0473; F01L 1/053; F01L 1/267; F01L 1/46; F01L 9/02; F01L 9/026;
(Continued)

(56) References Cited

U.S. PATENT DOCUMENTS 4,452,188 A * 6/1984 Kosuda ..... F01M 1/16 123/196 R
4,854,273 A * 8/1989 Uesugi ..... F01L 1/267 123/90.17

(Continued)

FOREIGN PATENT DOCUMENTS

DE 202008008142 U1 10/2008
DE 102010025099 A1 12/2011

(Continued)

*Primary Examiner* — Jorge L Leon, Jr.
(74) *Attorney, Agent, or Firm* — Weber Rosselli & Cannon LLP

(57) ABSTRACT

The present disclosure relates to a sliding cam system for an internal combustion engine. The sliding cam system has a camshaft and a plurality of cam carriers with in each case at least two cams, the plurality of cam carriers being arranged fixedly on the camshaft so as to rotate with it and in an axially displaceable manner. The sliding cam system has a plurality of fluid-actuated actuator apparatuses which are configured in each case for axially displacing a cam carrier of the plurality of cam carriers. The sliding cam system has a fluid feed apparatus which is provided for feeding a fluid in a fluidic connection upstream of the plurality of actuator apparatuses for actuating the plurality of actuator apparatuses. At least two actuator apparatuses of the plurality of actuator apparatuses are coupled fluidically for simultaneous actuation.

20 Claims, 4 Drawing Sheets

(51) Int. Cl.
*F01L 1/053* (2006.01)
*F01L 1/047* (2006.01)

(52) U.S. Cl.
CPC ... *F01L 13/0047* (2013.01); *F01L 2001/0471* (2013.01); *F01L 2001/34426* (2013.01); *F01L 2001/34469* (2013.01); *F01L 2013/0052* (2013.01); *F01L 2105/00* (2013.01); *F01L 2820/03* (2013.01); *F01L 2820/033* (2013.01); *F01L 2820/034* (2013.01); *F01L 2820/04* (2013.01); *F01L 2820/041* (2013.01)

(58) Field of Classification Search
CPC ..... F01L 2013/0052; F01L 2013/105; F01L 2013/106; F01L 2013/111; F01L 2013/113; F01L 2820/033; F01L 2820/034; F01L 2820/041; F01L 2820/042
USPC ..... 123/90.13, 90.14, 90.18, 90.27
See application file for complete search history.

(56) References Cited

U.S. PATENT DOCUMENTS

| | | | | |
|---|---|---|---|---|
| 6,244,230 | B1 * | 6/2001 | Mikame | F01L 1/344 123/90.17 |
| 8,176,887 | B2 | 5/2012 | Golz et al. | |
| 2011/0079191 | A1 * | 4/2011 | Lengfeld | F01L 1/053 123/90.18 |
| 2019/0003352 | A1 * | 1/2019 | Kataoka | F01L 1/026 |

FOREIGN PATENT DOCUMENTS

| | | | |
|---|---|---|---|
| DE | 102011075537 | A1 | 11/2012 |
| DE | 102011104382 | A1 | 12/2012 |
| EP | 0798451 | A1 | 10/1997 |
| EP | 2487341 | A1 | 8/2012 |
| WO | 2004083611 | A1 | 9/2004 |
| WO | 2012152456 | A1 | 11/2012 |

* cited by examiner

SLIDING CAM SYSTEM

BACKGROUND

The present disclosure relates to a sliding cam system for an internal combustion engine.

Valve-controlled internal combustion engines have one or more controllable inlet and outlet valves per cylinder. Variable valve control mechanisms make flexible actuation of the valves possible in order to change the opening time, closing time and/or the valve lift. As a result, the engine operation can be adapted, for example, to a specific load situation.

A variable valve train can be configured, for example, as a sliding cam system. A sliding cam system can have a plurality of cam carriers with a plurality of cams. The cam carriers are arranged fixedly on the camshaft so as to rotate with it and in an axially displaceable manner. The cam carriers can be displaced axially via actuators. A transmission apparatus, for example a rocker arm, sets one cam of the plurality of cams of the cam carrier in an operative connection with at least one gas exchange valve in a manner which is dependent on an axial position of the cam carrier. The cam carrier can be displaced axially in order to change a valve control curve of the at least one gas exchange valve, with the result that another cam of the cam carrier passes into engagement with the transmission apparatus. One example for a sliding cam system is disclosed in WO 2004/083611 A1.

EP 0 798 451 A1 has likewise disclosed a valve train with a sliding cam system. An actuating element is provided for displacing a cam with three cam tracks which lie axially next to one another. The actuation of the actuating element can take place pneumatically.

One disadvantage of known sliding cam systems frequently lies in the complex control system of the actuator apparatuses for displacing the cam carriers or cams with a plurality of cam tracks.

DE 10 2010 025 099 A1 discloses an adjustable camshaft, having at least one shaft, and having at least one cam pack which has at least two different cams and/or cam contours. The cam pack can be displaced axially on the shaft. An adjusting element is provided in the shaft, which adjusting element can be displaced at least axially relative to a longitudinal axis of the shaft. The adjusting element is coupled mechanically to the cam pack via a contact element. For example, at least two of the cam packs can be coupled mechanically to the adjusting element.

SUMMARY

The present disclosure is based on the object of providing an alternative or improved sliding cam system which overcomes disadvantages in the prior art and, in particular, has a simplified control system.

The sliding cam system is suitable for an internal combustion engine. The sliding cam system has a camshaft and a plurality of cam carriers with in each case at least two cams. The plurality of cam carriers are arranged fixedly on the camshaft so as to rotate with it and in an axially displaceable manner. The sliding cam system has a plurality of fluid-actuated actuator apparatuses which are configured in each case for axially displacing one cam carrier of the plurality of cam carriers. The sliding cam system has a fluid feed apparatus which is provided for feeding a fluid in a fluid connection upstream of the plurality of actuator apparatuses for actuating the plurality of actuator apparatuses. At least two actuator apparatuses of the plurality of actuator apparatuses are coupled fluidically for simultaneous actuation.

The fluid coupling between at least two actuator apparatuses makes the simultaneous actuation of the two actuator apparatuses possible by way of a fluid being fed. In this way, the control complexity can be simplified considerably, since not every actuator apparatus has to be actuated individually at a defined time. Instead, for example, only a single valve is opened in a fluid connection upstream of the actuator apparatuses, as a result of which the actuator apparatuses are actuated.

In particular, the at least two cams of the cam carriers can be of different configuration.

A plurality of transmission apparatuses, for example rocker arms or toggle levers, are preferably additionally provided, which set a first cam or a second cam of the respective cam carrier in an operative connection with at least one gas exchange valve in a manner which is dependent on an axial position of a respective cam carrier. The gas exchange valves can be, for example, inlet valves or outlet valves. The transmission apparatuses can have, in particular, a cam follower, for example a rotatable roller, for following a cam contour of a cam.

The actuator apparatuses may be of identical configuration.

For example, the actuator apparatuses can engage by way of displaceable elements into engagement tracks of the cam carriers for axially displacing the cam carriers.

For example, the actuator apparatuses can have displaceable elements which can be displaced in a radial direction with regard to a longitudinal axis of the camshaft or in an axial direction with regard to the longitudinal axis of the camshaft for axially displacing the respective cam carrier.

In one embodiment, the fluidically coupled, at least two actuator apparatuses are coupled fluidically by means of a group control valve of the fluid feed apparatus. In particular, a fluid can be fed at the same time to the fluidically coupled, at least two actuator apparatuses by way of opening of the group control valve. For example, the group control valve can be provided in a fluid connection downstream of a compressor or a pump and upstream of the at least two actuator apparatuses.

It is also possible that actuator-specific valves are additionally provided in a fluid connection between the group control valve and the actuators of the actuator apparatuses. Thus, actuator-specific control of the sliding cam system can in turn be made possible if this is desired.

In one embodiment, a plurality of actuator apparatus groups are provided which have in each case at least two fluidically coupled actuator apparatuses of the plurality of actuator apparatuses. The grouping of the actuator apparatuses in actuator apparatus groups makes a grouped actuation of the actuator apparatuses possible, as a result of which every actuator apparatus of an actuator apparatus group does not have to be actuated individually.

In another embodiment, the actuator apparatus groups of the plurality of actuator apparatus groups are provided in each case downstream of a respective group control valve of the fluid feed apparatus, with the result that the fluid can be fed by the fluid feed apparatus at the same time to the fluidically coupled, at least two actuator apparatuses of the respective actuator apparatus group by way of opening of the respective group control valve.

For example, a first actuator of a first actuator apparatus and a first actuator of a second actuator apparatus and optionally a first actuator of a third actuator apparatus can be provided in a first actuator apparatus group. In addition, a second actuator of the first actuator apparatus and a second actuator of the second actuator apparatus and optionally a second actuator of the third actuator apparatus can be provided in a second actuator apparatus group. Furthermore, a first actuator of a fourth actuator apparatus, a first actuator of a fifth actuator apparatus and optionally a first actuator of a sixth actuator apparatus can be provided in a third actuator apparatus group. In addition, a second actuator of the fourth actuator apparatus, a second actuator of the fifth actuator apparatus and optionally a second actuator of the sixth actuator apparatus can be provided in a fourth actuator apparatus group.

A first group control valve can be provided in a fluid connection upstream of the first actuator apparatus group, a second group control valve can preferably be provided in a fluid connection upstream of the second actuator apparatus, a third group control valve can be provided in a fluid connection upstream of the third actuator apparatus group, and/or a fourth group control valve can be provided in a fluid connection upstream of the fourth actuator apparatus group.

In a further embodiment, the group control valves are arranged in parallel to one another.

In a further embodiment, a first actuator of a first actuator apparatus is coupled fluidically to a first actuator of a second actuator apparatus. As an alternative or in addition, a second actuator of the first actuator apparatus is coupled fluidically to a second actuator of the second actuator apparatus. The couplings make it possible for the first actuators to be actuated simultaneously and for the second actuators to be actuated simultaneously.

In a further embodiment, the plurality of actuator apparatuses have in each case a first actuator for displacing a respective cam carrier in a first direction and a second actuator for displacing the respective cam carrier in a second direction which is opposed with respect to the first direction. The first direction and the second direction can run, in particular, parallel to a longitudinal axis of the camshaft.

The respective first actuators can be coupled fluidically at least partially to one another and/or the respective second actuators can be coupled fluidically at least partially to one another.

The plurality of actuator apparatuses may be actuated hydraulically or pneumatically. The actuator apparatuses can be connected, for example, to a hydraulic system or pneumatic system which is already present in a motor vehicle.

In a further embodiment, the sliding cam system additionally has a position sensor which detects a rotational position of the camshaft, an internal combustion engine sensor which detects an operating parameter of the internal combustion engine, and/or a user interface for a user input. The sliding cam system additionally has a control unit which is configured, based on the detected rotational position, the detected operating parameter and/or the user input, to control the fluid feed apparatus for feeding the fluid to the plurality of actuator apparatuses. The inclusion of the rotational position of the camshaft can ensure that the actuator apparatuses are actuated in such a way that, for example, displaceable elements of the actuator apparatuses are engaged completely before the respective cam carrier is displaced. A displacement of the cam carrier can be triggered, for example, via the detected operating parameter, for example a load of the internal combustion engine, or the user input.

The term "control unit" relates to control electronics which, depending on the configuration, can undertake control tasks and/or regulation tasks.

In a further embodiment, the control unit is configured, based on the detected rotational position, the detected operating parameter and/or the user input, to selectively actuate the group control valves.

In one embodiment, actuators of the plurality of actuator apparatuses have in each case a control fluid space and a retractable and extendable element, in particular a pin, in operative connection with the control fluid space. The retractable and extendable element extends by way of feeding of the fluid to the control fluid space in order to displace the respective cam carrier. In this way, a fluid-actuated actuator can be provided in a structurally simple way.

In a further embodiment, the fluid is a compressible gas, in particular air, and the control fluid space which is filled with the compressible gas acts as a pneumatic spring during the retraction of the retractable and extendable element. In this way, impacts and therefore premature wear of the actuator can be prevented. The pneumatic spring is effected by way of compression of the compressible gas and expelling of the compressed gas.

In a further embodiment, the retractable and extendable element engages into an engagement track of the cam carrier in order to displace the cam carrier. The control fluid is fed to the control fluid space (in particular, by way of corresponding opening of the corresponding group control valve) in such a way that the retractable and extendable element makes contact with an outer circumferential face of the cam carrier before the retractable and extendable element engages into the engagement track. In other words, the fluid-actuated actuator apparatuses make it possible for the cam-free sections which have the engagement tracks to be moved over by the displaceable elements before the displaceable elements finally engage into the engagement tracks. In this way, control complexity for the actuator apparatus is reduced considerably, since the time window for actuating the actuator apparatuses is increased.

The retractable and extendable element may be prestressed by way of an elastic element into a retracted state. As a result, the retractable and extendable element can be returned into a basic position.

In a further embodiment, the control fluid space is configured as an annular space in the retracted state of the retractable and extendable element. This makes it possible that a contact area between a bottom face of the control fluid space and the retractable and extendable element is small. In particular, the control fluid can bear directly against the retractable and extendable element and/or only a low adhesion force can exist between the bottom face and the retractable and extendable element.

For example, the retractable and extendable element may have a journal which extends in a direction of a bottom face of the control fluid space. Alternatively or additionally, a bottom face of the control fluid space may have a journal which extends in a direction of the retractable and extendable element.

In a further embodiment, the control fluid space is sealed towards a surrounding area of the actuator apparatus by way of a fluid seal, in particular an O-ring. In this way, the penetration of oil mist into the control fluid space can be prevented.

The present disclosure also relates to a motor vehicle, in particular a commercial vehicle (for example, an omnibus or a lorry), having a sliding cam system as disclosed herein. The fluid feed apparatus preferably has a compressed air tank of the motor vehicle and/or the fluid feed apparatus is integrated into a pneumatic system of the motor vehicle.

The above-described preferred embodiments and features of the present disclosure can be combined with one another as desired.

BRIEF DESCRIPTION OF THE DRAWINGS

Further details and advantages of the present disclosure will be described in the following text with reference to the appended drawings, in which.

Figure 1:
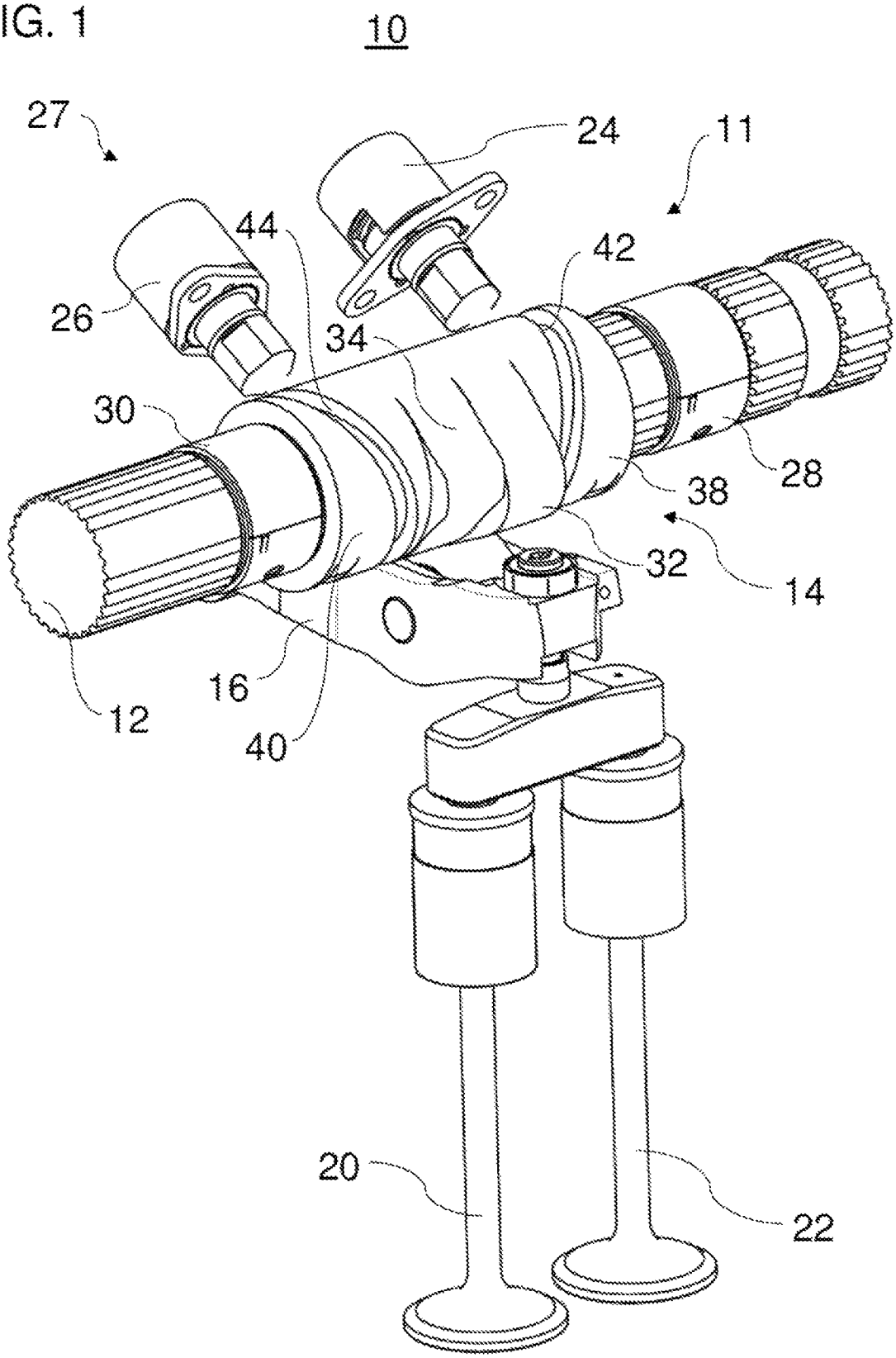
FIG. 1 shows a perspective view of an exemplary variable valve train.

The embodiments which are shown in the figures correspond to one another at least in part, with the result that similar or identical parts are provided with the same reference numerals and reference is also made to the description of the other embodiments and figures in order to explain them, in order to avoid repetitions.

DETAILED DESCRIPTION

FIG. 1 shows a variable valve train 10. The variable valve train 10 can be included in a motor vehicle, in particular a commercial vehicle, having an internal combustion engine. The commercial vehicle can be, for example, a lorry or an omnibus.

The variable valve train 10 has a camshaft 12 and a cam carrier 14. In addition, the variable valve train 10 has a transmission apparatus 16 and a first and second gas exchange valve 20 and 22. In addition, the variable valve train 10 has a first actuator 24 and a second actuator 26. The first actuator 24 and the second actuator 26 form an actuator apparatus 27. In other embodiments, the actuator apparatus can have, for example, only one actuator or a plurality of actuators which are provided in a common housing.

Figure 2:
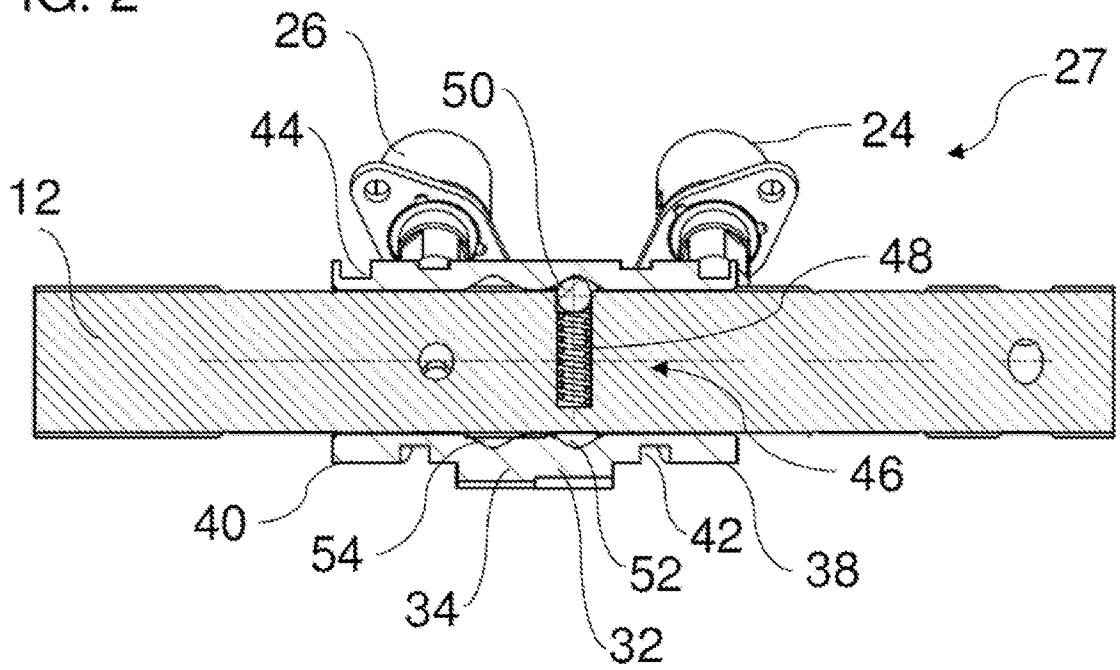
FIG. 2 shows a longitudinal sectional view of the camshaft.

The cam carrier 14, the camshaft 12 and the actuator apparatus 27 form a part of a sliding cam system 11. The sliding cam system 11 has a plurality of cam carriers 14 and actuator apparatuses for a plurality of cylinders of the internal combustion engine. In the following text, the construction of the sliding cam system is described by way of example for a cam carrier 14 and an actuator apparatus 27 for a cylinder of the internal combustion engine, as shown in FIGS. 1 and 2.

The camshaft 12 can be configured as an inlet camshaft, an outlet camshaft or a mixed camshaft which actuates both inlet valves and outlet valves. The camshaft 12 can be part of a double camshaft system (not shown in detail) which additionally has a further camshaft (not shown). The camshaft 12 is arranged as an overhead camshaft. In other embodiments, the camshaft 12 can also be arranged as an OHV camshaft.

The cam carrier 14 is arranged fixedly on the camshaft 12 so as to rotate with it. The cam carrier 14 is additionally arranged such that it can be displaced axially along a longitudinal axis of the camshaft 12. The cam carrier 14 can be capable of being displaced axially between a first stop 28 and a second stop 30.

The cam carrier 14 has two cams 32 and 34 which are offset from one another in a longitudinal direction of the cam carrier 14 and the camshaft 12. The first cam 32 and the second cam 34 are arranged in a central section of the cam carrier 14. The first cam 32 and the second cam 34 adjoin one another. The first cam 32 and the second cam 34 are of different configuration, with the result that they can bring about different valve lift curves of the gas exchange valves 20, 22. The first cam 32 can be, for example, an engine brake cam for an outlet valve, and the second cam 34 can be a normal cam. In other embodiments, the cam carriers can have a different number of cams, different arrangements of the cams and/or different cam contours of the cams.

In addition, the cam carrier 14 has a first cam-free section 38 and a second cam-free section 40. The first cam-free section 38 and the second cam-free section 40 are arranged at opposite ends of the cam carrier 14. A first engagement track (switch guide plate) 42 extends spirally about a longitudinal axis of the cam carrier 14 in the first cam-free section 38. A second engagement track (switch guide plate) 44 extends spirally about the longitudinal axis of the cam carrier 14 in the second cam-free section 40.

In order to displace the cam carrier 14 between the stops 28 and 30, the actuators 24 and 26 can engage with extendable elements (not shown in detail in FIGS. 1 and 2) selectively into the engagement tracks 42, 44. The actuators 24, 26 can be of identical configuration. In detail, the first actuator 24 can engage selectively into the first engagement track 42 in order to displace the cam carrier 14 from a first axial position to a second axial position. The cam carrier 14 bears against the second stop 30 in the first axial position. The cam carrier 14 bears against the first stop 28 in the second axial position. FIG. 1 shows the cam carrier 14 in the first axial position. The second actuator 26 in turn can engage selectively into the second engagement track 44. The cam carrier 14 is then displaced from the second axial position to the first axial position.

The displacement is triggered by virtue of the fact that the extendable element of the respective actuator 24, 26 is stationary with regard to an axial direction of the camshaft 12. As a consequence, the displaceable cam carrier 14 is displaced in a longitudinal direction of the camshaft 12 on account of the spiral shape of the engagement tracks 42, 44 when the extendable element engages into the respective engagement track 42, 44. At the end of the displacement operation, the extendable element of the respective actuator 24, 26 is guided by the respective engagement track 42, 44 in an opposite direction to the extending direction and is therefore retracted. The extendable element of the respective actuator 24, 26 passes out of engagement with the respective engagement track 42, 44.

The transmission apparatus 16 establishes an operative connection between the cam carrier 14 and the gas exchange valves 20, 22. The gas exchange valves 20, 22 are actuated (opened) when the first cam 32 or the second cam 34 presses the transmission apparatus 16 downwards.

If the cam carrier 14 is situated in the first axial position, the transmission apparatus 16 is in an operative connection between the first cam 32 and the gas exchange valves 20, 22. In other words, the transmission apparatus 16 is not in an operative connection between the second cam 34 and the gas exchange valves 20, 22 in the first axial position of the cam carrier 14. The gas exchange valves 20, 22 are actuated in accordance with a contour of the first cam 32. In the second axial position of the cam carrier 14, the transmission apparatus 16 is in an operative connection between the second cam 34 and the gas exchange valves 20, 22 which are actuated in accordance with a contour of the second cam 34.

In the embodiment which is shown, the transmission apparatus 16 is configured as a rocker arm. In other embodiments, the transmission apparatus 16 can be configured as a toggle lever or as a tappet. In some embodiments, the transmission apparatus 16 can have a cam follower, for example in the form of a rotatable roller.

A locking apparatus 46 is shown with reference to FIG. 2. The locking apparatus 46 has an elastic element 48 and a locking body 50. The elastic element 48 is arranged in a blind bore of the camshaft 12. The elastic element 48 prestresses the locking body 50 against the cam carrier 14. A first and second recess 52 and 54 are arranged in an inner circumferential face of the cam carrier 14. In order to lock the cam carrier 14, the locking body 50 is pressed, for example, into the first recess 52 when the cam carrier 14 is in the first axial position. In the second axial position of the cam carrier 14, the locking body 50 is pressed into the second recess 54.

Figure 3:
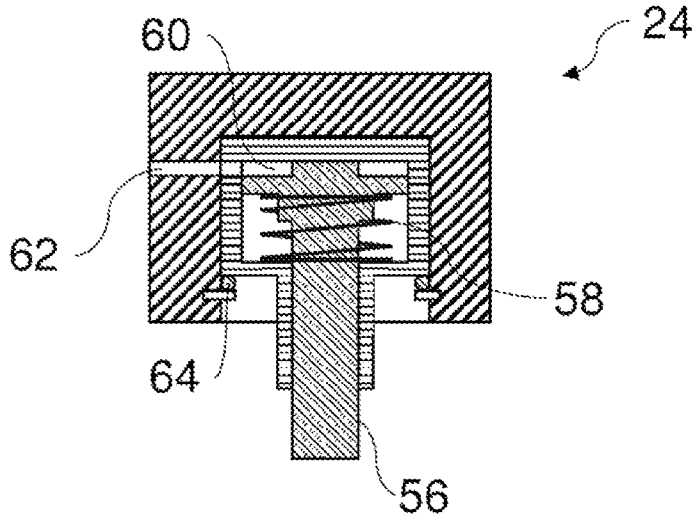
FIG. 3 shows a diagrammatic sectional view of an exemplary actuator.
Figure 4:
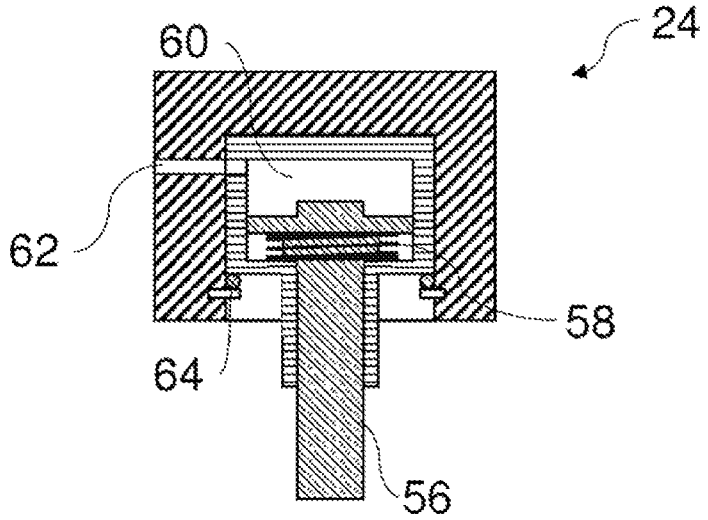
FIG. 4 shows a further diagrammatic sectional view of the exemplary actuator.
Figure 5:
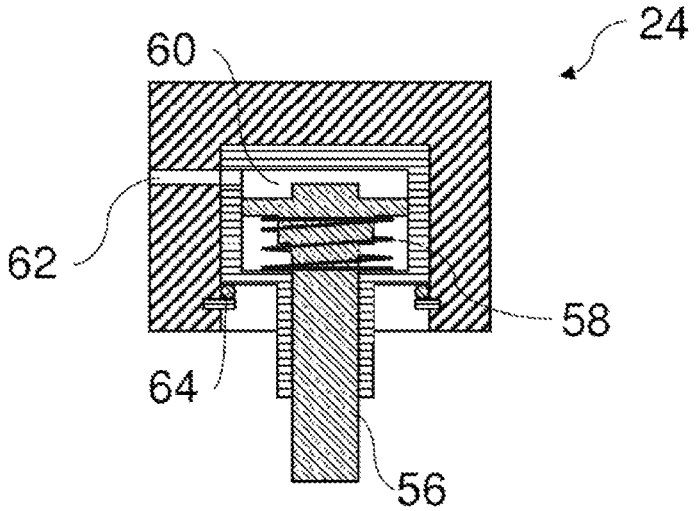
FIG. 5 shows a further diagrammatic sectional view of the exemplary actuator.

FIGS. 3 to 5 show the actuator 24 in greater detail by way of example. FIG. 3 shows the actuator 24 in a basic position (in the retracted state). FIG. 4 shows the actuator 24 during the working stroke (in the extended state). FIG. 5 shows the actuator 24 during a spring-back (during the retraction).

The actuator 24 is fluid-actuated. In particular, the actuator 24 is a pneumatic or hydraulic actuator. The actuator 24 is preferably actuated pneumatically, since this can be advantageous with regard to a temperature insensitivity and a speed which can be achieved.

The actuator 24 has a displaceable pin (piston) 56, an elastic element 58, a control fluid space 60 and a control fluid feed duct 62.

A control fluid, for example air or hydraulic liquid, can be fed to the control fluid space 60 via the control fluid feed duct 62. The feed of control fluid to the control fluid space 60 brings about ejection of the pin 56 from the control fluid space 60. The extended pin 56 can engage into the engagement track 42, in order to displace the cam carrier 14 axially.

The pin 56 and the control fluid space 60 can be configured in such a way that the control fluid space 60 is configured as an annular space in the retracted state of the pin. For example, the pin 56 can be provided with a journal, as shown in FIGS. 3 to 5. The annular space makes it possible that the control fluid can already bear against the pin 56 at the beginning of the actuation. In this way, a displacement of the pin 56 can begin directly by way of feeding of control fluid to the control fluid space 60. In addition, only low adhesion forces have to be overcome in order to bring about a start of the displacement of the pin 56, on account of the small contact area between the pin 56 and a bottom face of the control fluid space 60.

The fluid actuation of the actuator 24 makes it possible that the pin 56 moves over the cam-free section 38 (see FIG. 1) before the engagement into the engagement track 42 (see FIG. 1). Here, an outer circumferential face of the cam-free section 38 makes contact with the pin 56 and prevents the pin 56 from extending further. As soon as the engagement track 42 begins, the pin 56 can engage directly into the engagement track 42. In this way, the control complexity of the actuator 24 can be reduced considerably in comparison with systems which require a precisely timed extension and engagement of the pin of the actuator. This can be the case, for example, in the case of electromagnetically actuated actuators.

At the end of the displacement operation of the cam carrier 14, a ramp of the engagement track 42 presses the pin 56 in the direction of the control fluid space 60. If a compressible fluid is used as control fluid, the fluid is compressed and expelled during the retraction of the pin 56. The fluid which is situated in the control fluid space 60 therefore acts as a pneumatic spring during the retraction operation of the pin 56. The elastic element 58 brings about a complete return of the pin 56 into the basic position (into the retracted state).

In order to prevent penetration of, for example, oil mist into the control fluid space 60, a fluid seal 64, for example a sealing ring, can be provided. In addition, the control fluid space 60 can have, for example, a ventilating duct (not shown).

Figure 6:
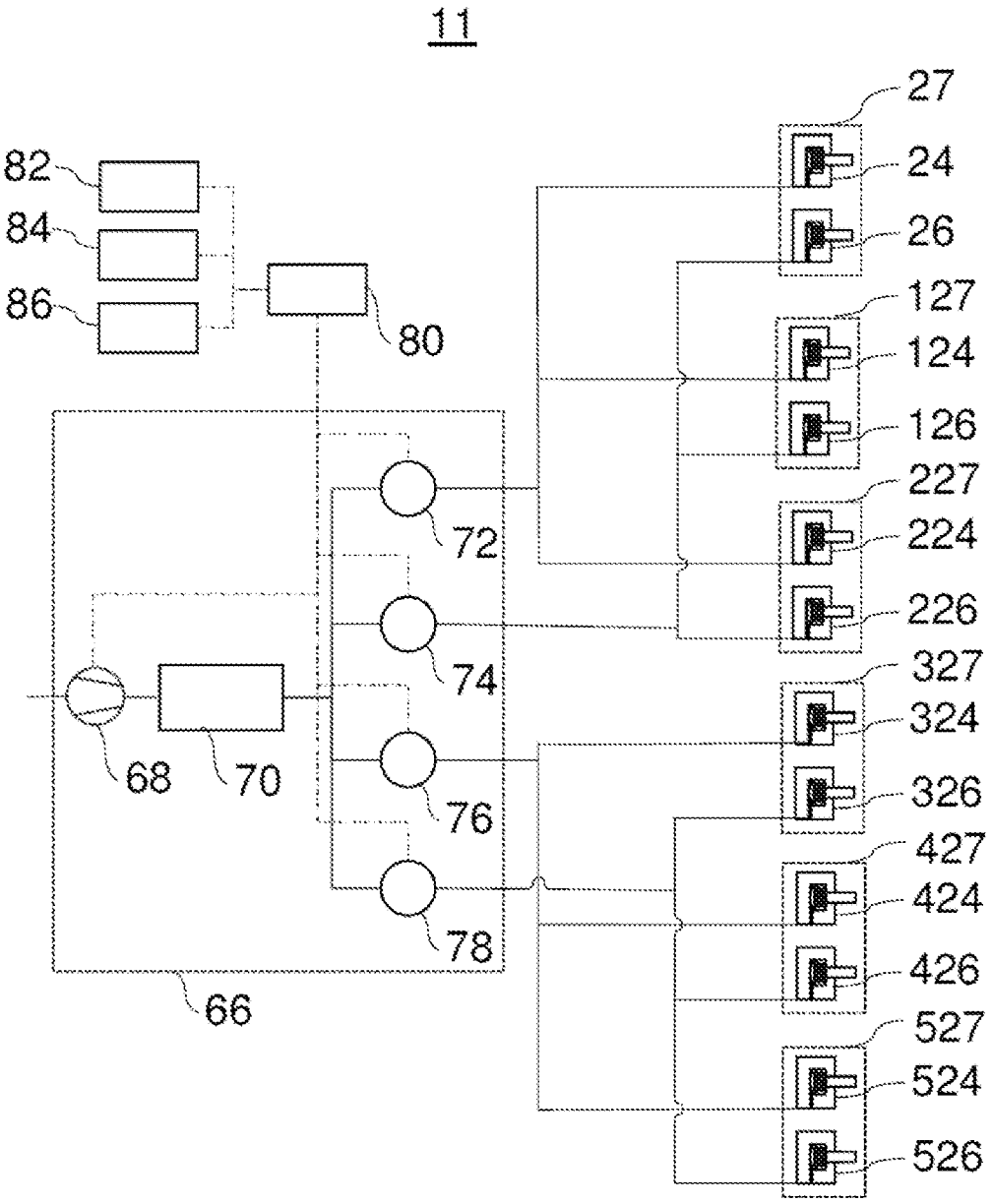
FIG. 6 shows a diagrammatic view of a sliding cam system.

With reference to FIG. 6 the fluid-actuated actuator apparatuses can simplify control of the sliding cam system 11. In particular, a plurality of actuator apparatuses can be actuated at the same time, with the result that a complicated actuator-selective actuation can be dispensed with. This can reduce the control complexity considerably.

The sliding cam system 11 has a first actuator apparatus 27, a second actuator apparatus 127, a third actuator apparatus 227, a fourth actuator apparatus 327, a fifth actuator apparatus 427 and a sixth actuator apparatus 527. The second to sixth actuator apparatuses 127, 227, 327, 427, 527 can be configured like the actuator apparatus 27. In particular, the second to sixth actuator apparatuses 127, 227, 327, 427, 527 can have in each case two actuators 124, 126; 224, 226; 324, 326; 424, 426 and 524, 526 for displacing a respective cam carrier (not shown). The actuators 26, 124, 126, 224, 226, 324, 326, 424, 426, 524 and 526 can be configured like the actuator 24 which is described with reference to FIGS. 3 to 5.

A fluid feed apparatus 66 is provided in a fluid connection upstream of the fluid-actuated actuator apparatuses 27, 127, 227, 327, 427, 527. The fluid feed apparatus 66 is configured by way of example as a pneumatic fluid feed apparatus. The fluid feed apparatus 66 has a compressor 68, a pressure tank 70 and four group control valves 72, 74, 76 and 78.

The compressor 68 conveys a fluid for storage into the pressure tank 70. For example, the compressor 68 can convey air into the pressure tank 70. The pressure tank 70 can be, in particular, a compressed air tank of a commercial vehicle, which compressed air tank also provides compressed air, for example, for other pneumatically actuated apparatuses of the commercial vehicle. The pressure level can lie, for example, between 8 bar and 12 bar.

The compressor 68 and the four group control valves 72, 74, 76 and 78 are controlled by a control unit 80. The control unit 80 is connected to a position sensor 82, an internal combustion engine sensor 84 and a user interface 86. The position sensor 82 detects a position of the camshaft 12 (see FIG. 1). The internal combustion engine sensor 84 detects at least one operating parameter of the internal combustion engine, for example a parameter which specifies a load of the internal combustion engine. The user interface 86 makes a user input into the control unit 80 possible. The control unit 80 controls operation of the compressor 68 and the four group control valves 72, 74, 76 and 78 in a manner which is based on signals which are received from the position sensor 82, the internal combustion engine sensor 84 and the user interface 86.

The group control valves 72, 74, 76 and 78 are provided downstream of the compressor 68 and the pressure tank 70. The first group control valve 72 is provided in a fluid connection upstream of the actuators 24, 124, 224. The second group control valve 74 is provided in a fluid connection upstream of the actuators 26, 126, 226. The third group control valve 76 is provided in a fluid connection upstream of the actuators 324, 424, 524. The fourth group control valve 78 is provided in a fluid connection upstream of the actuators 326, 426, 526. In this way, the group control valves 72, 74, 76 and 78 couple the actuator apparatuses 27, 127, 227, 327, 427 and 527 partially. Thus, for example, merely the first group control valve 72 has to be opened by the control unit 80 in order to actuate the actuators 24, 124, 224.

In the present embodiment, the actuators 24, 26, 124, 126, 224, 226, 324, 326, 424 and 426 are divided via the group control valves 72, 74, 76 and 78 into four groups for common actuation. The actuators are coupled fluidically within one group. In other embodiments, more or fewer groups can be provided with in each case more or fewer actuators, in order to reduce a control complexity for the sliding cam system.

The present disclosure is not restricted to the above-described preferred exemplary embodiments. Rather, a multiplicity of variants and modifications are possible which likewise utilize the concept of the present disclosure and therefore fall within the scope of protection. In particular, the present disclosure includes a configuration of the fluid feed apparatus and the fluid coupling of at least two actuator apparatuses.

LIST OF REFERENCE NUMERALS

10 Variable valve train
11 Sliding cam system
12 Camshaft
14 Cam carrier
16 Transmission apparatus (rocker arm)
20 First gas exchange valve
22 Second gas exchange valve
24 First actuator
26 Second actuator
27 First actuator apparatus
28 First stop
30 Second stop
32 First cam
34 Second cam
38 First cam-free section
40 Second cam-free section
42 First engagement track
44 Second engagement track
46 Locking apparatus
48 Elastic element
50 Locking body
52 First recess
54 Second recess
56 Pin (retractable and extendable element)
58 Elastic element
60 Control fluid space
62 Control fluid feed duct
64 Fluid seal
66 Fluid feed apparatus
68 Compressor
70 Pressure tank (Compressed air tank)
72 First group control valve
74 Second group control valve
76 Third group control valve
78 Fourth group control valve
80 Control unit
82 Position sensor
84 Internal combustion engine sensor
86 User interface
124 First actuator
126 Second actuator
127 Second actuator apparatus
224 First actuator
226 Second actuator
227 Third actuator apparatus
324 First actuator
326 Second actuator
327 Fourth actuator apparatus
424 First actuator
426 Second actuator
427 Fifth actuator apparatus
524 First actuator
526 Second actuator
527 Sixth actuator apparatus

We claim:

1. A sliding cam system for an internal combustion engine, the sliding cam system comprising:

a camshaft;

a plurality of cam carriers each including at least two integrally-formed cams, the plurality of cam carriers being arranged on the camshaft rotationally fixed so as to rotate with the camshaft and in an axially displaceable manner;

a plurality of fluid-actuated actuator apparatuses configured to axially displace a respective cam carrier of the plurality of cam carriers, wherein each actuator apparatus of the plurality of fluid-actuated actuator apparatuses includes a control fluid space and a retractable and extendable element partially disposed in the control fluid space, and wherein a fluid selectively fed to the control fluid space acts on the retractable and extendable element causing the retractable and extendable element to extend into an engagement track of the respective cam carrier so as to axially displace the respective cam carrier; and a fluid feed apparatus for feeding the fluid in a fluidic connection upstream of the plurality of fluid-actuated actuator apparatuses so as to actuate the plurality of fluid-actuated actuator apparatuses, wherein at least two actuator apparatuses of the plurality of fluid-actuated actuator apparatuses are coupled fluidically so as to actuate simultaneously.

2. The sliding cam system according to claim 1, wherein the at least two actuator apparatuses are coupled fluidically by means of a group control valve of the fluid feed apparatus, and wherein the fluid is fed to the at least two actuator apparatuses simultaneously by opening the group control valve.

3. The sliding cam system according to claim 1, further comprising a plurality of actuator apparatus groups, each of the plurality of actuator apparatus groups including at least two fluidically coupled actuator apparatuses of the plurality of fluid-actuated actuator apparatuses.

4. The sliding cam system according to claim 3, wherein each actuator apparatus group is downstream of a respective group control valve of the fluid feed apparatus, and wherein within each actuator apparatus group the fluid is fed by the fluid feed apparatus to the at least two actuator apparatuses simultaneously by of opening the respective group control valve.

5. The sliding cam system according to claim 4, wherein the respective group control valves of each actuator apparatus group are arranged in parallel to one another.

6. The sliding cam system according to claim 1, further comprising:

a first actuator of a first actuator apparatus of the plurality of fluid-actuated actuator apparatuses coupled fluidically to a first actuator of a second actuator apparatus of the plurality of fluid-actuated actuator apparatuses; or a second actuator of the first actuator apparatus being coupled fluidically to a second actuator of the second actuator apparatus.

7. The sliding cam system according to claim 1, wherein each fluid-actuated actuator apparatus includes a first actuator for displacing a respective cam carrier in a first direction, and a second actuator for displacing the respective cam carrier in a second direction which is opposite the first direction.

8. The sliding cam system according to claim 1, wherein the plurality of fluid-actuated actuator apparatuses is actuated hydraulically or pneumatically.

9. The sliding cam system according to claim 1, further comprising:

a position sensor which detects a rotational position of the camshaft, an internal combustion engine sensor which detects an operating parameter of the internal combustion engine, or a user interface for a user input; and a control unit configured to control the fluid feed apparatus based on the detected rotational position, the detected operating parameter, or the user input.

10. The sliding cam system according to claim 9, wherein the control unit is further configured to selectively actuate a response group control valve of the fluid feed apparatus based on the detected rotational position, the detected operating parameter, or the user input.

11. The sliding cam system according to claim 1, wherein the retractable and extendable element is a pin.

12. The sliding cam system according to claim 1, wherein the fluid is a compressible gas, and the control fluid space is filled with the compressible gas such that the compressible gas acts as a pneumatic spring during retraction of the retractable and extendable element.

13. The sliding cam system according to claim 12, wherein the compressible gas is air.

14. The sliding cam system according to claim 1, wherein the fluid is fed to the control fluid space in such a way that the retractable and extendable element makes contact with an outer circumferential face of the respective cam carrier before the retractable and extendable element engages the engagement track.

15. The sliding cam system according to claim 1, wherein the retractable and extendable element is prestressed by an elastic element into a retracted state.

16. The sliding cam system according to claim 1, wherein the control fluid space is configured as an annular space in a retracted state of the retractable and extendable element.

17. The sliding cam system according to claim 1, wherein each actuator apparatus further includes a fluid seal configured to seal the control fluid space from a surrounding area of the actuator apparatus.

18. A motor vehicle, comprising:

a sliding cam system for an internal combustion engine, the sliding cam system including:

a camshaft;

a plurality of cam carriers each including at least two integrally-formed cams, the plurality of cam carriers being arranged on the camshaft rotationally fixed so as to rotate with the camshaft and in an axially displaceable manner;

a plurality of fluid-actuated actuator apparatuses configured to axially displace a respective cam carrier of the plurality of cam carriers, wherein each actuator apparatus of the plurality of fluid-actuated actuator apparatuses includes a control fluid space and a retractable and extendable element partially disposed in the control fluid space, and wherein a fluid selectively fed to the control fluid space acts on the retractable and extendable element causing the retractable and extendable element to extend into an engagement track of the respective cam carrier so as to axially displace the respective cam carrier; and a fluid feed apparatus for feeding the fluid in a fluidic connection upstream of the plurality of fluid-actuated actuator apparatuses so as to actuate the plurality of fluid-actuated actuator apparatuses, wherein at least two actuator apparatuses of the plurality of fluid-actuated actuator apparatuses are coupled fluidically so as to actuate simultaneously.

19. The motor vehicle of claim 18, wherein the fluid feed apparatus is a compressed air tank of the motor vehicle.

20. The motor vehicle of claim 18, wherein the motor vehicle is a commercial vehicle.

* * * * *